US011191324B2

(12) United States Patent
Fiedler

(10) Patent No.: US 11,191,324 B2
(45) Date of Patent: Dec. 7, 2021

(54) TOGGLE LEVER CLOSURE

(71) Applicant: Fidlock GmbH, Hannover (DE)

(72) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 159 days.

(21) Appl. No.: 16/342,683

(22) PCT Filed: Oct. 4, 2017

(86) PCT No.: PCT/EP2017/075250

§ 371 (c)(1),
(2) Date: Apr. 17, 2019

(87) PCT Pub. No.: WO2018/073007

PCT Pub. Date: Apr. 26, 2018

(65) Prior Publication Data

US 2020/0046085 A1 Feb. 13, 2020

(30) Foreign Application Priority Data

Oct. 21, 2016 (DE) ..... 10 2016 220 740.7

(51) Int. Cl.

| | |
|---|---|
| ***A44B 11/25*** | (2006.01) |
| *A43B 1/00* | (2006.01) |
| *A43C 11/14* | (2006.01) |

(52) U.S. Cl.

CPC ..... *A44B 11/2588* (2013.01); *A43B 1/0054* (2013.01); *A43C 11/1406* (2013.01); *A44D 2203/00* (2013.01)

(58) Field of Classification Search

CPC ..... A44B 11/2588; A43C 11/1406; A43B 1/0054; A44D 2203/00

See application file for complete search history.

(56) References Cited

U.S. PATENT DOCUMENTS

| | | | | |
|---|---|---|---|---|
| 9,770,069 | B2 * | 9/2017 | Munns | A43C 11/1406 |
| 9,907,367 | B2 * | 3/2018 | Paik | A41F 1/002 |
| 9,936,772 | B2 * | 4/2018 | Paik | A45F 3/047 |
| 10,098,422 | B2 * | 10/2018 | Fiedler | A44C 5/0007 |
| 10,111,499 | B2 * | 10/2018 | Fiedler | A44B 11/18 |
| 10,143,270 | B2 | 12/2018 | Fiedler et al. | |
| 10,212,993 | B2 | 2/2019 | Fiedler et al. | |
| 10,617,179 | B2 * | 4/2020 | Fiedler | A44B 11/12 |
| 2015/0296924 | A1 | 10/2015 | Doyle | |

(Continued)

FOREIGN PATENT DOCUMENTS

| | | |
|---|---|---|
| DE | 1050103 | 12/1957 |
| EP | 1900399 A1 | 3/2008 |

(Continued)

*Primary Examiner* — Robert Sandy
*Assistant Examiner* — Louis A Mercado
(74) *Attorney, Agent, or Firm* — The Webb Law Firm

(57) ABSTRACT

Disclosed is a toggle lever closure, including a first closure element, a second closure element which is pivotable about a first pivot axis with respect to the first closure element in order to close the toggle lever closure, and a tensioning element which is connected in an articulated manner to the second closure element about a second pivot axis spaced apart from the first pivot axis. At least one magnetic device acts between the first closure element and the second closure element and/or between the first closure element and the tensioning element.

15 Claims, 8 Drawing Sheets

(56) References Cited

U.S. PATENT DOCUMENTS

| | | | | |
|---|---|---|---|---|
| 2015/0337879 | A1* | 11/2015 | Tucholke | A44B 11/2588<br>24/303 |
| 2016/0255924 | A1* | 9/2016 | Hatanaka | A44C 5/243 |
| 2017/0245601 | A1* | 8/2017 | Banks | A63B 71/12 |
| 2020/0054101 | A1* | 2/2020 | Fiedler | A44B 11/258 |

FOREIGN PATENT DOCUMENTS

| | | | |
|---|---|---|---|
| WO | 2014090926 | A1 | 6/2014 |
| WO | 2014180512 | A1 | 11/2014 |

* cited by examiner

TOGGLE LEVER CLOSURE

CROSS-REFERENCE TO RELATED APPLICATIONS

This application is the United States national phase of International Application No. PCT/EP2017/075250 filed Oct. 4, 2017, and claims priority to German Patent Application No. 10 2016 220 740.7 filed Oct. 21, 2016, the disclosures of which are hereby incorporated by reference in their entirety.

BACKGROUND OF THE INVENTION

Field of the Invention

The disclosure relates to a toggle lever closure.

Description of Related Art

A toggle lever closure of this type comprises a first closure element, a second closure element which is pivotable about a first pivot axis with respect to the first closure element in order to close the toggle lever closure, and a tensioning element which is connected in an articulated manner to the second closure element about a second pivot axis spaced apart from the first pivot axis.

Toggle lever closures of this type have long been known from the prior art and can serve, for example, for tensioning a tensioning strap or else for the firm closing of a ski boot or another sports shoe. In such a toggle lever closure, the second closure element can be attached to the first closure element in order to close the toggle lever closure, wherein, in order to open the toggle lever closure, the second closure element is separable from the first closure element, and the first closure element and the second closure element can therefore be released from each other.

However, in another refinement, it is also possible to connect the first closure element and the second closure element to each other in an articulated and nonreleasable manner, wherein, in this case, for example, the tensioning element can be releasably connectable to a tension element, for example a belt, a strap or another element configured for transmitting tensile forces (this is frequently realized, for example, in the case of ski boots, in which a tensioning element engages in a tension element in the manner of a toothed belt).

A toggle lever closure which, firstly, can easily be closed, by identifying the parts to be attached to each other, and, secondly, is reliably held in the closed position is desirable. The toggle lever closure is intended to be simple to operate, to permit haptically pleasant opening and closing and to be able to ensure reliable grip.

SUMMARY OF THE INVENTION

It is an object underlying the proposed solution to provide a toggle lever closure which, for a user, is operable in a simple manner, with reliable grip in the closed position.

This object is achieved by a toggle lever closure with the features described herein.

According thereto, the toggle lever closure has at least one magnetic device which acts between the first closure element and the second closure element and/or between the first closure element and the tensioning element.

The toggle lever closure is therefore of magnetic design, with the magnetic device being able to carry out different functions.

Firstly, the magnetic device can act, for example, between the first closure element and the second closure element in such a manner that, when the second closure element is attached to the first closure element, the closure elements are identified in a simple, reliable and positionally correct manner. In this case, the magnetic device therefore facilitates the identifying of the closure elements for closing the toggle lever closure.

Secondly, it is conceivable and possible for the magnetic device to act between the first closure element and the second closure element and/or between the first closure element and the tensioning element, and therefore the toggle lever closure is reliably and resiliently held in its closed position. In this case, the magnetic device therefore acts in particular for fixing in the closed position.

In one refinement, the second closure element is attachable to the first closure element in order to close the toggle lever closure and is removable from the first closure element in order to open the toggle lever closure. In this refinement of a toggle lever closure, the first closure element and the second closure element are therefore releasable from each other. Attaching of the second closure element to the first closure element and subsequent pivoting of the second closure element relative to the first closure element causes the tensioning element, which is connected in an articulated manner to the second closure element, to be moved and thereby causes a tensile force to be exerted on a tension element adjoining the tensioning element, and therefore the toggle lever closure is closed by tensioning the tensioning element. For the opening, the second closure element can be pivoted back in relation to the first closure element, and therefore the tension on the tensioning element is loosened. By removal of the second closure element from the first closure element, the toggle lever closure is then opened.

In this refinement, the first closure element can have, for example, a fastening element and the second closure element can have an engagement portion, wherein the engagement portion is attachable to the fastening element for the articulated connection of the second closure element to the first closure element. The engagement portion can extend, for example, longitudinally along the first axis of rotation and can be realized by a strut element which provides an axis of articulation for pivoting the second closure element with respect to the first closure element. After the second closure element is attached to the first closure element, the engagement portion acts on the fastening element of the first closure element, wherein the engagement of the engagement portion with the fastening element is such that an articulated connection is created between the second closure element and the first closure element.

The second closure element can have an integral pivoting part on which, firstly, the engagement portion is arranged and on which, secondly, the tensioning element acts. The engagement portion and the second pivot axis, about which the tensioning element is pivotable relative to the second closure element, are spaced apart from each other here, and therefore, during pivoting of the second closure element relative to the first closure element, the tensioning element is moved and a tension element adjoining the tensioning element is thereby tensioned.

In one refinement, the second closure element can be configured by means of a wire clip, in which the engagement portion is realized by means of a transverse strut of the clip. The wire clip can be hooked into the fastening element, which is of hook-shaped design in this case, and therefore, after the hooking-in, there is an articulated connection between the second closure element and the first closure element.

In an alternative refinement, the second closure element can also be formed in two parts with parts which are movable with respect to each other. The second closure element can thus have, for example, a pivoting part and an attachment element which is connected in an articulated manner to the pivoting part. The tensioning element is connected in an articulated manner to the pivoting part. By contrast, the attachment element can be attached to the first closure element and bears the engagement portion, and therefore, after the attachment element is attached to the first closure part, the attachment element is held in a positively locking manner on the first closure part and therefore produces a connection between the second closure element and the first closure element.

The attachment element can be designed, for example, as described in WO 2014/180512 A1, the content of which is intended to be fully incorporated here.

Alternatively, the attachment element can also be designed, for example, as described in WO 2014/090926 A1, the content of which is likewise intended to be fully incorporated here.

In particular, the engagement portion can be extended rectilinearly along the first pivot axis. In this case, the engagement portion is therefore directed transversely with respect to a loading direction (directed perpendicularly to the pivot axes).

Alternatively, the engagement portion may, however, also be extended at an oblique angle with respect to the first pivot axis.

Again alternatively, the engagement portion can have a V shape, with two portions which are extended at an angle to each other and in each case obliquely with respect to the first pivot axis and together form a V. The tip of the V can point here in a loading direction, as is described in WO 2014/090926 A1.

If the first closure element and the second closure element are attached to each other (releasably) in order to close the toggle lever closure, the magnetic device can serve in particular to magnetically assist the attachment of the second closure element to the first closure element. For this purpose, the magnetic device can be designed in order, upon attachment, to draw the engagement portion of the second closure element magnetically into engagement with the fastening element of the first closure element. During the attaching of the second closure element to the first closure element, the parts are therefore very substantially identified automatically, and therefore the attaching is considerably simplified for the user and a user in particular only needs to bring the second closure element close to the first closure element such that the magnetic device can then draw the engagement portion into engagement with the fastening element.

In a specific refinement, a first magnetic element can be arranged on the first closure element in the region of the fastening element, while a second magnetic element is arranged on the second closure element in the region of the engagement portion. The first and the second magnetic elements can be designed here as a permanent magnet. However, it is conceivable and possible also for one of the magnetic elements to be formed by a permanent magnet and the other of the magnetic elements by a ferromagnetic anchor, and therefore there is a magnetic attraction between the magnetic elements. If the engagement portion is brought into the vicinity of the fastening element, the magnetic elements are attracted in such a manner that the engagement portion is drawn into engagement with the fastening element and therefore the second closure element is arranged in an articulated manner on the first closure element.

If the second closure element is configured with an integral pivoting part, the second closure element can therefore be pivoted about the first pivot axis. If the second closure element is formed in two parts with an attachment element and a pivoting part (which is pivotable about the first pivot axis with respect to the attachment element), after attachment the pivoting part can be pivoted relative to the attachment element.

If the second closure element is designed as a wire clip, it is possible, for example, for the wire clip itself to have ferromagnetic properties, and therefore, upon attachment to the first closure element, the second closure element in the form of the wire clip is magnetically attracted by the first closure element. Alternatively or additionally, a cylindrical magnet or a cylindrical structural element with ferromagnetic properties, which is attachable to the fastening element of the first closure element, can be arranged on the second closure element in the form of the wire clip.

In an alternative refinement of the toggle lever closure, as already explained at the beginning, the second closure element can be connected to the first closure element in an articulated manner about the first pivot axis, but nonreleasably. In this case, the second closure element is therefore connected in an articulated manner to the first closure element, wherein the articulated connection, however, cannot be released in order to open the toggle lever closure. In this case, the tensioning element can have, for example, a connecting element, for example in the form of a hook or an eyelet, which is releasably connectable to a tension element for transmitting tensile forces. By hooking of the tensioning element into the tension element and by subsequent pivoting of the second closure element with respect to the first closure element, the toggle lever closure can therefore be closed, by a tensioning effect on the tensioning element.

In an alternative refinement, the tensioning element can also be fixedly connected to the tension element. This applies to both basic refinements of the toggle lever closure (i.e. in the case of a releasable connection of the second closure element to the first closure element and in the case of a nonreleasable connection of the second closure element to the first closure element). The tensioning element is therefore connected nonreleasably to the tension element, wherein, by pivoting of the second closure element relative to the first closure element, tension is brought about on the tensioning element and, as a result, a tensile force is exerted on the tension element.

In one refinement, in a closed position, the second closure element is arranged with respect to the first closure element in such a manner that the connecting element of the tensioning element and the second pivot axis come to lie on different sides of the first pivot axis. In order to close the toggle lever closure, the second closure element is pivoted relative to the first closure element, and therefore the second closure element is brought closer to the first closure element and the first closure element and the second closure element come to lie, for example, approximately on each other. The tensioning element is thereby drawn in the pivoting direction and thus tensioned, and therefore tensile forces are exerted on a tension element adjoining the tensioning element. For example, in the closed position, the second closure element can lie with its pivoting part against a body of the first closure element, and therefore the second closure element takes up a defined position relative to the first closure element.

In this case, the magnetic device can in particular (also) serve for fixing the toggle lever closure in the closed position. For this purpose, at a location which is spaced apart from the first pivot axis, the magnetic device can act in a magnetically attracting manner between the first closure element and the second closure element or between the first closure element and the tensioning element, and therefore the toggle lever closure is held in the closed position. Owing to the fact that the magnetic device acts at a distance from the first pivot axis, the magnetic fixing forces act with a lever arm with respect to the first pivot axis, with it being possible for the magnetic fixing to act between the first closure element and the second closure element or else between the first closure element and the tensioning element.

The magnetic forces can be dimensioned here in such a manner that, in the event of loading during operation, opening of the toggle lever closure is not possible because of the loading forces which act on the toggle lever closure. Opening is possible only by conscious actuation in order to pivot back the second closure element relative to the first closure element.

Additionally or alternatively, a latching device can be provided which mechanically latches the first closure element and the second closure element (and/or the first closure element and the tensioning element) in the closed position. An additional mechanical latching is therefore provided which holds the toggle lever closure in the closed position.

In one refinement, spring-mechanical pretensioning forces can act between the tensioning element and the second closure element and pretension the second closure element about the second pivot axis (about which the second closure element and the tensioning element are connected in an articulated manner to each other) in relation to the tensioning element in the direction of a preferred position.

Such pretensioning can be brought about, for example by means of a leg spring which acts about the second pivot axis.

However, such pretensioning can also be brought about by the fact that the second closure element, for example, has arms which are offset with respect to each other along the second pivot axis and act on the tensioning element at different locations which are offset with respect to each other transversely with respect to the second pivot axis. The arms are (very substantially) relaxed in a preferred position. However, if the second closure element is moved relative to the tensioning element, bracing is brought about at the arms, which leads to spring pretensioning.

In one embodiment, the second closure element has an operating element which can be actuated in order to open the toggle lever closure. The operating element can be configured, for example, as a flexible, pliable release tab (for example a piece of tape) which can be pulled in order to open the toggle lever closure. For example, in the closed position of the toggle lever closure, the operating element can project below the tensioning element in such a manner that pulling on the operating element can force the tensioning element to be raised and the second closure element to be released from the first closure element.

Another structure form of a closure device comprises a first closure element which has a fastening element in the form of a hook, and a second closure element in the form of a wire clip for attaching to the fastening element of the first closure element. It is provided here that the first closure element interacts in a magnetically attracting manner with the second closure element. A particularly simple closure is therefore created in which a second closure element in the form of a wire clip for closing the closure is simply hooked into a hook-shaped fastening element of a first closure element. Magnetic forces act between the first closure element and the second closure element, and therefore the attaching of the second closure element to the first closure element is magnetically assisted.

In one refinement, the first closure element can have a first magnetic element or can be manufactured at least in sections from a ferromagnetic material. Additionally or alternatively, the second closure element can have a second magnetic element or can be manufactured at least in sections from a ferromagnetic material. In each case, magnetically attracting magnetic forces act between the first closure element and the second closure element. The attaching of the second closure element to the first closure element is therefore magnetically assisted, and, in addition, the grip of the second closure element on the first closure element when the closure device is closed is magnetically secured.

Such a closure device can be part of a toggle lever closure, as has been described above. In this context, reference should be made to what has been explained above.

BRIEF DESCRIPTION OF THE DRAWINGS

The concept on which the solution is based will be explained in more detail below with reference to the embodiments illustrated in the figures.

DESCRIPTION OF THE INVENTION

Figure 1:
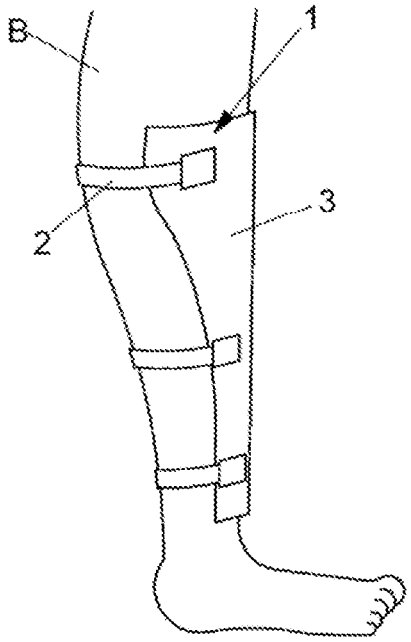
FIG. 1 shows a schematic view of an orthopedic aid which is to be fastened to the extremity of a patient via toggle lever closures.

FIG. 1 shows, in a schematic view, an orthopedic aid 3 in the form of a splint which can be attached to the extremity of a patient, in the example illustrated to the leg B of the patient, and serves, for example, as a knee or foot orthosis. For this purpose, the orthopedic aid 3 is attached to the leg B and fixed via a plurality of tension elements 2 in the form of tapes by using toggle lever closures 1.

Various embodiments of such toggle lever closures 1 will be explained below, wherein reference should already be made here to the fact that such toggle lever closures can be used in an entirely different manner and to this extent are not restricted to the use of orthopedic aids. Toggle lever closures 1 can be used, for example, in general for tensioning a strap or belt, for example as a closure of a container or else as a closure for a sports shoe, for example a ski boot.

In an embodiment of a toggle lever closure 1 that is illustrated in FIGS. 2A to 2D, a first closure element 10 has a body 100 which is fastened, for example, fixedly to an object, for example to an orthopedic aid 3 according to FIG. 1. From the body 100 protrudes a fastening element 101 to which a second closure element 11 can be attached in such a manner that an engagement portion 112 of the second closure element 11 comes to lie against a sliding surface 104, which is bounded by a projection 102, of the fastening element 101 and therefore creates an articulated connection between the second closure element 11 and the first closure element 10. A tensioning element 12 (in the form of a clip in the embodiment illustrated) is attached in an articulated manner to the second closure element 11 via ends 121, wherein a tension element 2, for example in the form of a tape or strap, can be attached to a connecting element 120 which is remote from the second closure element 11 and is in the form of a clip-type strut.

In the embodiment illustrated, the second closure element 11 and the first closure element 10 are releasable from each other. In order to close the toggle lever closure 1, the second closure element 11 is attached by the engagement portion 112 to the fastening element 111, and therefore the engagement portion 112 comes to lie with a sliding surface 114 on the sliding surface 104 of the fastening element 101. After the attaching, the second closure element 11 is pivotable about a first pivot axis D1 in relation to the first closure element 10, as is illustrated in the transition from FIGS. 2A and B to FIGS. 2C and D.

When the second closure element 11 is attached to the first closure element 10, the fastening element 101 of the first closure element 10 comes into engagement with an opening 111 on a pivoting part 110 of the second closure element 11. The attaching of the second closure element 11 to the first closure element 10 and the identifying of the engagement portion 112 with the fastening element 101 is magnetically assisted here by magnetic elements 103, 113 which are arranged, firstly, in the region of the fastening element 101 on the body 100 of the first closure element 10 and, secondly, in the region of the engagement portion 112 on the second closure element 11, as illustrated schematically in FIG. 2B. The magnetic elements 103, 113 are opposite each other in a magnetically attracting manner, and therefore the engagement portion 112 is automatically drawn into engagement with the fastening element 101 and in particular the sliding surfaces 104, 114 enter into contact with each other.

By contrast, the tensioning element 12 is pivotable about a second pivot axis D2 in relation to the second closure element 11. By pivoting of the second closure element 11 in relation to the first closure element 10, the tensioning element 12 is carried along, and therefore a tensile force is exerted on the tension element, which is attached to the tensioning element 12, and therefore the tension element 2 is tensioned.

Figure 2C:
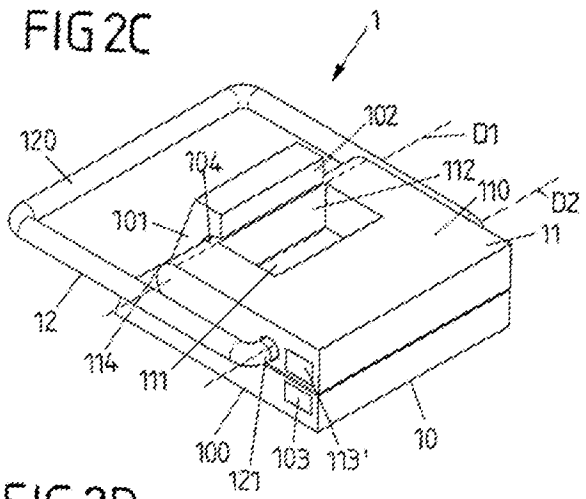
FIG. 2C shows a perspective view of the toggle lever closure in a closed position.
Figure 2D:
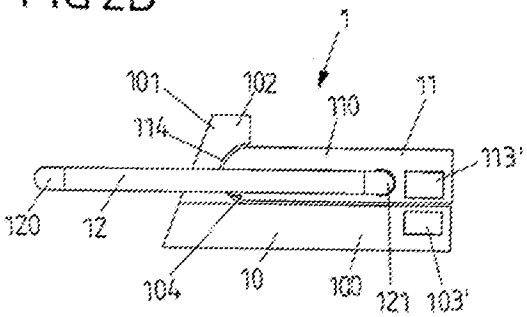
FIG. 2D shows a side view of the arrangement according to FIG. 2C.

In the closed position, illustrated in FIGS. 2C and 2D, the second closure element 11 with the pivoting part 110 is in contact with the body 100 of the first closure element 10. In the closed position, the second pivot axis D2 comes to lie on a first side of the fastening element 101 while the connecting element 120 of the tensioning element 12, on which the tension element 2 acts, is arranged on another, second side of the fastening element 101. The second pivot axis D2 and the connecting element 120 are therefore arranged on different sides of the fastening element 101.

A magnetic element 103' is arranged on the body 100 of the first closure element 10 (in addition to the magnetic element 103), said magnetic element 103' in the closed position lying in a magnetically attracting manner opposite a magnetic element 113' (additional to the magnetic element 113) on the pivoting part 110 of the second closure element 11. The second closure element 11 is therefore magnetically held in the closed position, and therefore the position of the second closure element 11 in relation to the first closure element 10 is thereby fixed in the closed position.

The magnetic attraction is preferably dimensioned in such a manner that an unintentional release, in particular under the action of a load acting on the tensioning element 12 via the tension element 2, is not readily possible, at any rate not without conscious opening of the second closure element 11.

Figure 2A:
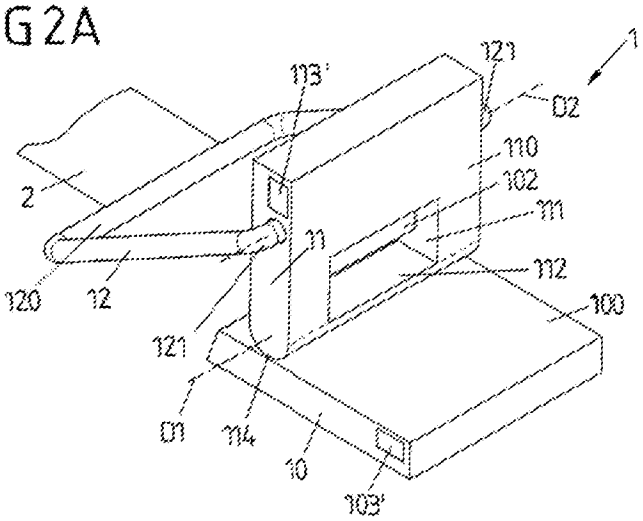
FIG. 2A shows a perspective view of a first embodiment of a toggle lever closure, during the closing.
Figure 2B:
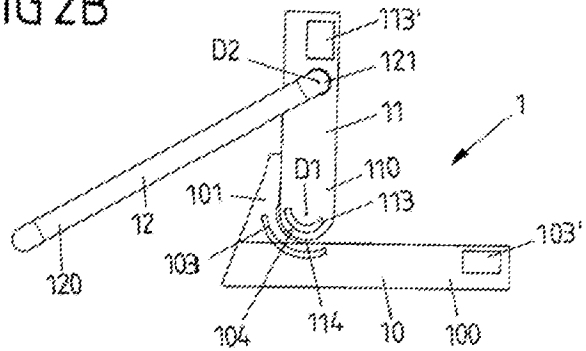
FIG. 2B shows a side view of the arrangement according to FIG. 2A.

For the opening, the second closure element 11 can be pivoted back out of the position illustrated in FIGS. 2C and 2D into the position illustrated in FIGS. 2A and 2B such that the magnetic elements 103', 113' are separated from each other. The closure elements 10, 11 can then be removed from each other such that the connection between the closure elements 10, 11 is released.

In an embodiment of a toggle lever closure 1 that is illustrated in FIGS. 3A to 3D, the second closure element 11 is realized as a wire clip which can be attached to a fastening element 101 in the form of a hook of a first closure element 10.

In the embodiment illustrated, a magnetic element 103 is arranged on the fastening element 101 in the region of the sliding surface 104, said magnetic element 103, when the second closure element 11 is attached, facing a magnetic element 113 on a transverse strut 116 of the second closure element 11. The magnetic element 113 can be designed as a permanent magnet or else as a ferromagnetic component and is opposite the magnetic element 103 on the fastening element 101 in a magnetically attracting manner.

It is conceivable here to configure the magnetic element 103 of the fastening element 101 as a permanent magnet. In this case, the magnetic element 113 can be configured as a permanent magnet or else as a ferromagnetic component.

However, it is also conceivable to design the magnetic element 103 as a ferromagnetic component. In this case, the magnetic element 113 is realized by a permanent magnet.

If the magnetic element 103 is designed as a permanent magnet, a separate cylindrical magnetic element 113 can optionally also be omitted if the wire clip realizing the second closure element 11 is manufactured from a ferromagnetic material and thus itself interacts in a magnetically attracting manner with the magnetic element 103.

Remotely from the magnetic element 113, the second closure element 11 in the form of the wire clip is connected in an articulated manner to a tensioning element 12 on which a tension element 2, for example in the form of a strap or tape, is arranged. The toggle lever closure 1 serves for tensioning the tensioning element 12 by the second closure element 11, as is illustrated in the transition between FIGS. 3A and 3B to FIGS. 3C and 3D, being pivoted about the first pivot axis D1 in relation to the first closure element 10.

Figure 3A:
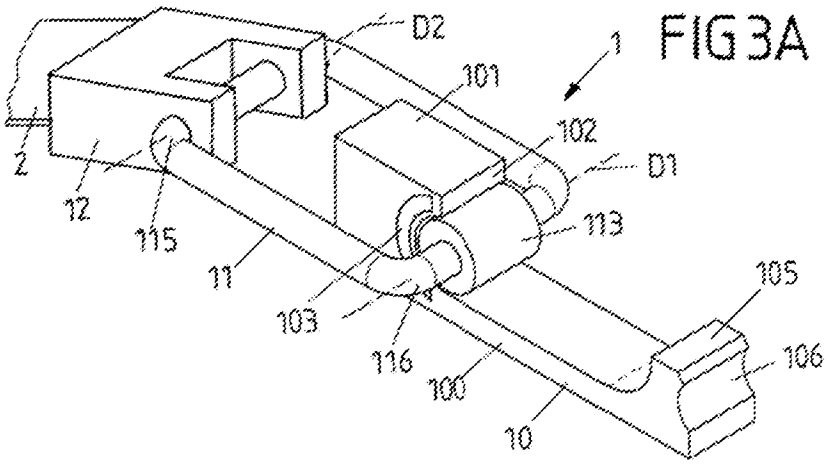
FIG. 3A shows a perspective view of a further embodiment of a toggle lever closure, during the closing.
Figure 3B:
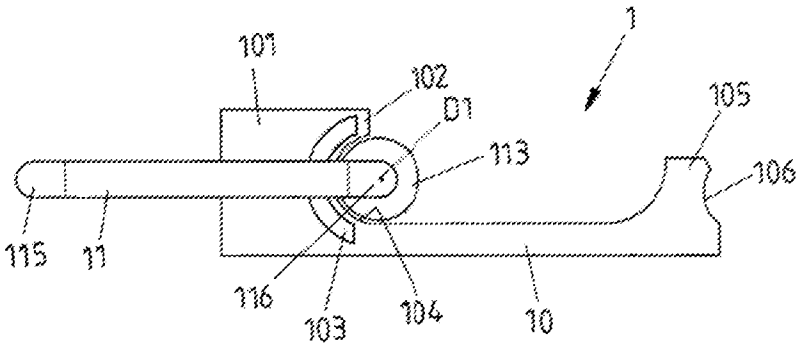
FIG. 3B shows a side view of the arrangement according to FIG. 3A.
Figure 3C:
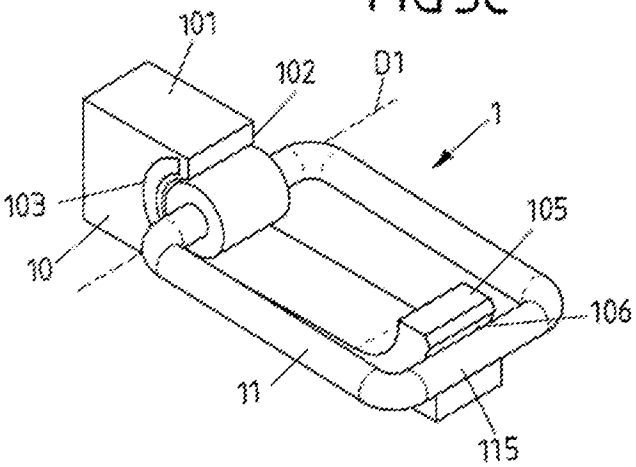
FIG. 3C shows a perspective view of the toggle lever closure, in a closed position.
Figure 3D:
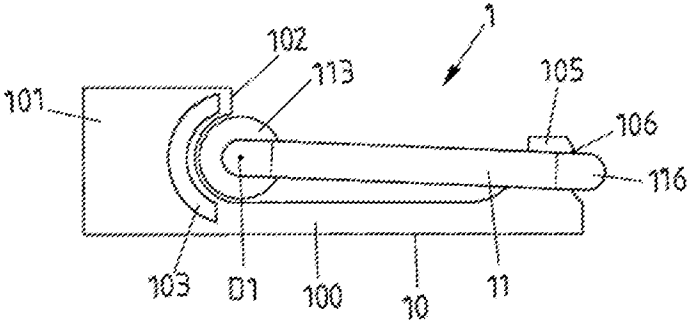
FIG. 3D shows a side view of the arrangement according to FIG. 3C.

In the closed position, illustrated in FIGS. 3C and 3D, the second closure element 11 in the form of the wire clip is pivoted toward a latching device 105 on the body 100 of the first closure element in such a manner that a transverse strut 115 of the second closure element 11 enters into engagement with a latching recess 106 of the latching device 105 and the second closure element 11 is therefore held in position in a latching manner with respect to the first closure element 10.

In the closed position, the second closure element 11 is therefore latched to the first closure element 10. The tensioning element 12 is also held in position via the second closure element 11, and therefore the toggle lever closure 1 is fixed in its closed position.

In order to release the toggle lever closure 1, the second closure element 11 can be released from the latching, and therefore the second closure element 11 can be pivoted out of the position according to FIGS. 3C and 3D in the direction of the position according to FIGS. 3A and 3B in order then for the second closure element 11 to be removed from the first closure element 10 and for the toggle lever closure 1 to be opened.

A closure device of the type illustrated in FIGS. 3A to 3D can also be used without a tensioning element 12. In this case, the closure is not configured as a toggle lever closure, but rather as a simple closure, in which a second closure element 11 is hooked in a simple manner into the fastening element 101 of the first closure element 10 in order to close the closure device and the grip of the closure elements 10, 11 on each other is mechanically secured.

In this case, a latching device is not required. The closure is closed by simple hooking of the second closure element 11 into the first closure element 10.

In an embodiment of a toggle lever closure 1 that is illustrated in FIGS. 4A to 4D, the second closure element 11 is formed in two parts. The second closure element 11 has an attachment element 117 which can be designed as described in WO 2014/180512 A1, the content of which is intended to be fully incorporated here.

A pivoting part 110 is connected in an articulated manner pivotably about the first pivot axis D1—to the attachment element 117, said pivoting part being extended with arms 118, 119 from the attachment element 117 and being connected to a connecting portion 123 of a tensioning element 12 via said arms 118, 119.

Figure 4A:
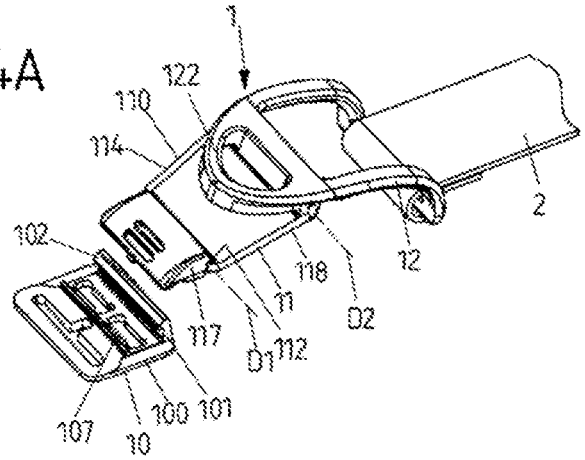
FIG. 4A shows a perspective view of a further embodiment of a toggle lever closure, before the closing.
Figure 4B:
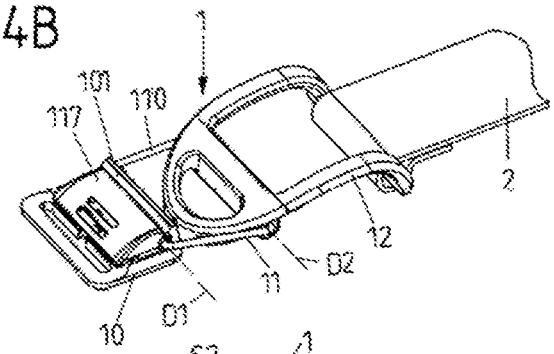
FIG. 4B shows a view of the toggle lever closure during the closing.

In order to close the toggle lever closure 1, the attachment element 117 is attached to the first closure element 10 such that the attachment element 117 enters with an engagement portion 112 into engagement in the fastening element 101 and the projection 112 arranged thereon, as is illustrated in FIG. 4B. The attachment element 117 comes to lie here between the fastening element 101 and a blocking element 107 in the form of a projection on the body 100 of the first closure element 10, and therefore the position of the attachment element 117 on the first closure element 10 is defined.

Both the attachment element 117 and the body 100 of the first closure element 10 each have a magnetic element here, and therefore the attachment element 117 is attached to the body 100 in a magnetically assisted manner. The attachment element 117 is attracted by the body 100, and therefore the attachment element 117 enters in a magnetically assisted manner into the position illustrated in FIG. 4B.

Figure 4C:
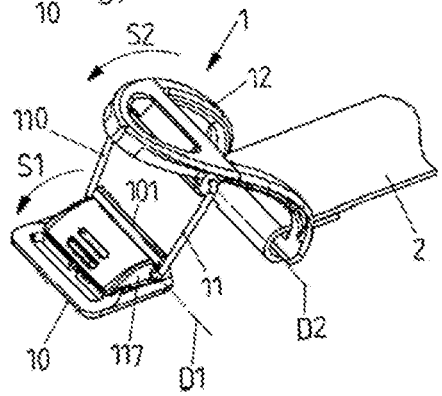
FIG. 4C shows a view of the toggle lever closure during the further closing.
Figure 4D:
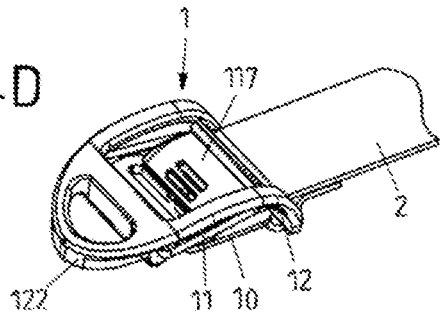
FIG. 4D shows a view of the toggle lever closure in a closed position.

If the attachment element 117 has been attached to the first closure element 10, the pivoting part 110 can be pivoted about the first pivot axis D1 in relation to the attachment element 117 in order thereby to tension the tensioning element 12 with the tension element 2 arranged thereon, as is illustrated in the transition from FIG. 4B to FIG. 4D.

The pivoting part 110 is pivoted here in a pivoting direction S1 about the first pivot axis D1 in relation to the attachment element 117 and therefore in relation to the first closure element 10, wherein the tensioning element 12 is pivoted in a pivoting direction S2 about the second pivot axis D2 in relation to the pivoting part 110, as is apparent in the transition from FIG. 4B to FIG. 4D. The tension element 2 on the tensioning element 12 is carried along in the process and is therefore tensioned.

A handle 122 on which a user can act, in order to close the toggle lever closure 1 or else to open same again, is mounted on the tensioning element 12. A user can thus pull on the handle 142 for opening purposes and can therefore lift the tensioning element 12 such that the pivoting part 110 is pivoted back about the first pivot axis D1 and also the tensioning element 12 is pivoted about the pivot axis D2.

Figure 5A:
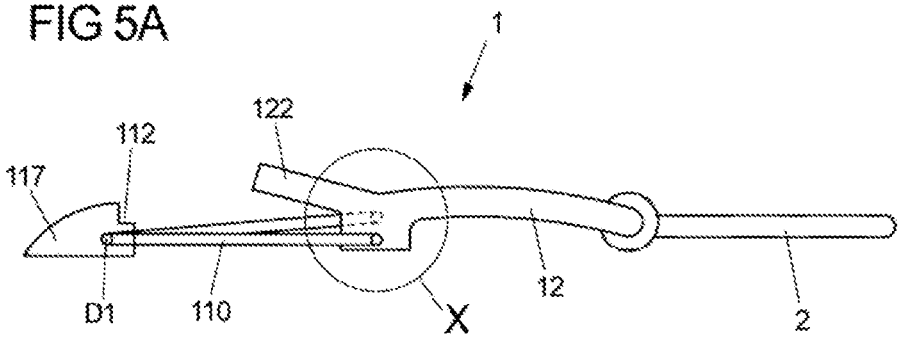
FIG. 5A shows a schematic view for explaining the toggle lever closure according to FIGS. 4A to 4D.
Figure 5B:
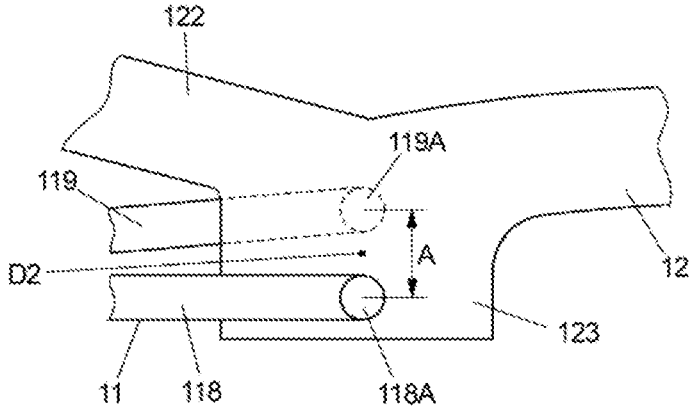
FIG. 5B shows an enlarged view in the detail X according to FIG. 5A.
Figure 5C:
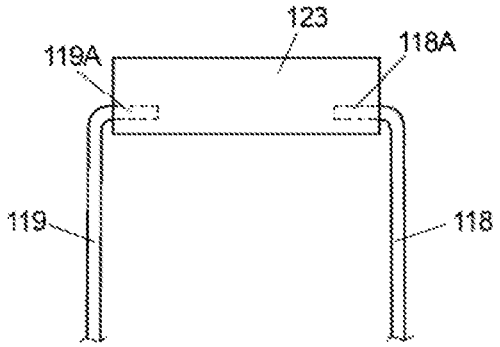
FIG. 5C shows a top view for explaining the toggle lever closure.
Figure 6C:
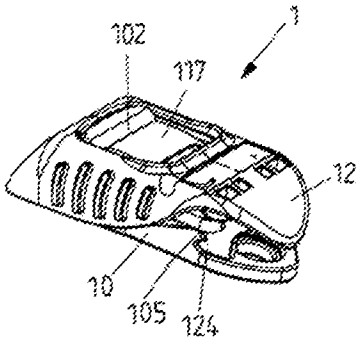
FIG. 6C shows a view of the toggle lever closure in a closed position.
Figure 6A:
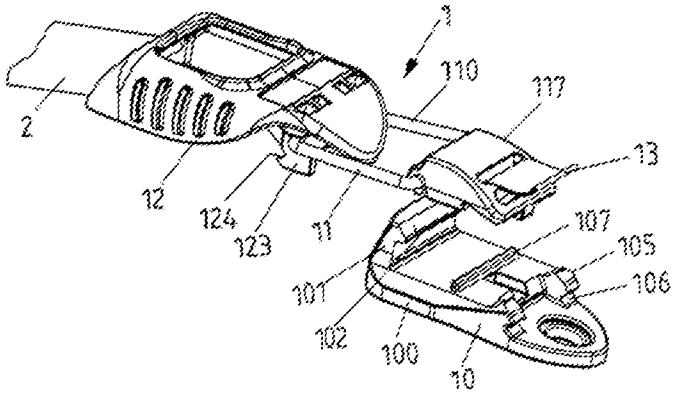
FIG. 6A shows a view of a further embodiment of a toggle lever closure, before the closing.
Figure 6B:
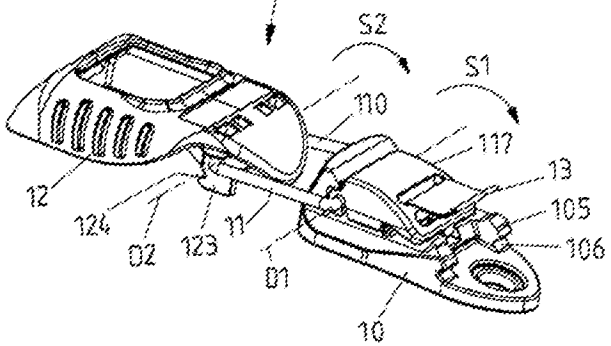
FIG. 6B shows a view of the toggle lever closure during the closing.

In the embodiment according to FIGS. 4A to 4D, the arms 118, 119 of the pivoting part 110, via which arms the attachment element 117 is connected to the tensioning element 12, are not extended parallel to each other, but rather run at an angle to each other, as is illustrated in FIGS. 5A to 5C. As is apparent from the enlarged view according to FIG. 5B, the arms 118, 119 thus act with their ends 118A, 118B on the connecting portion 123 of the tensioning element 12 at a distance A transversely with respect to the (virtual in this case) second pivot axis D2, which leads to the pivoting part 110 being pretensioned into a preferred position.

In said preferred position, illustrated in FIGS. 5A and 5B, the arms 118, 119 are very substantially relaxed. During pivoting of the pivoting part 110 relative to the tensioning element 12 about the second pivot axis D2, the arms 118, 119 are deformed, which leads to tensioning forces on the arms 118, 119, said tensioning forces attempting to reset the pivoting part 110 in the direction of the preferred position.

The ends 118A, 119A can act here on the tensioning element 12, for example in mutually offset openings on both sides of the connecting portion 123, and therefore the arms 118, 119 are held via their ends 118A, 119A at a distance A from each other on the connecting portion 123.

The pivoting part 110 can also be pretensioned in relation to the tensioning element 12 in another way, for example via a leg spring which acts about the second pivot axis D2 and pretensions the pivoting part 110 in the direction of a preferred position in relation to the tensioning element 12.

In the case of an embodiment of a toggle lever closure 1 that is illustrated in FIGS. 6A to 6C and 7A, 7B, an engagement element 117 (which is configured similarly as in the embodiment according to FIGS. 4A to 4D) is attached to a first closure element 10 for closing the toggle lever closure 1 and thereby enters into engagement with a fastening element 101 of the first closure element 10. Via a blocking element 107 in the form of a projection on the body 100 of the first closure element 10, the position of the attachment element 117 to the rear of the fastening element 101 is also defined by the attachment element 117 being accommodated between the fastening element 101 and the blocking element 107.

Figure 7B:
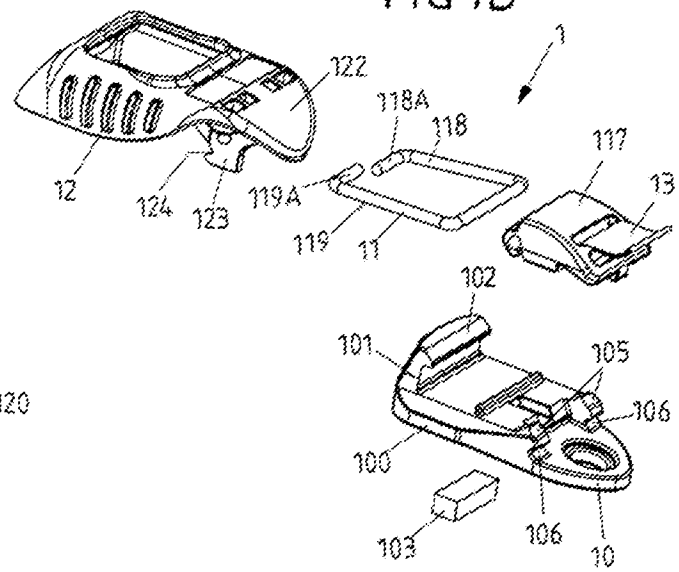
FIG. 7B shows a further exploded view of the toggle lever closure according to FIGS. 6A to 6C.
Figure 7A:
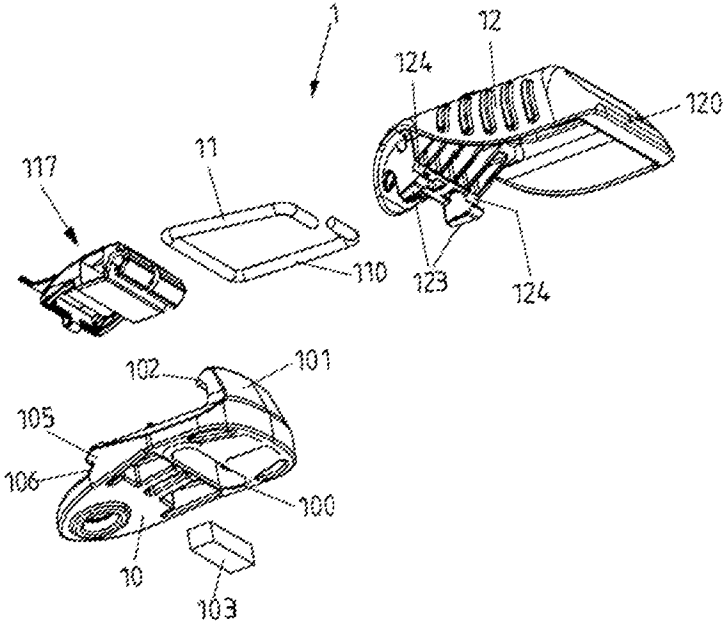
FIG. 7A shows an exploded view of the toggle lever closure according to FIGS. 6A to 6C.

The first closure element 10 has a magnetic element 103, as is apparent from FIGS. 7A and 7B, and the attachment element 117 likewise has a magnetic element (not visible in the figures), and therefore, during the attaching, the attachment element 117 is drawn magnetically into engagement with the fastening element 101.

Both the first closure element 10 and the attachment element 117 can have a magnetic element in the form of a permanent magnet here. However, it is also conceivable and possible for one of the elements to have a permanent magnet and the other of the elements to have a ferromagnetic anchor.

The closing of the toggle lever closure 1 takes place entirely analogously as described previously for the embodiment according to FIGS. 4A to 4D. By pivoting of the pivoting part 110 about the first pivot axis D1 relative to the attachment element 117 and therefore relative to the first closure element 10, and by simultaneous pivoting of the tensioning element 12 about the second pivot axis D2 relative to the pivoting part 110, the toggle lever closure 1 passes into the closed position according to FIG. 6C in which the tensioning element 12 substantially lies on the first closure element 10 and therefore a tension element 2 acting on the tensioning element 12 (see FIG. 6A) is tensioned.

A latching device 124 in the form of two hooks is formed on a connecting portion 123, to which the pivoting part 110 of the second closure element 11 is attached in an articulated manner about the second pivot axis D2, said hooks, in the closed position of the toggle lever closure 1, being in engagement with a latching device 105 in the form of two latching recesses 106 of the first closure element 10 such that the tensioning element 12 is latched in relation to the first closure element 10. The toggle lever closure 1 is therefore secured in the closed position and cannot readily, at any rate not unintentionally, be opened under the action of load forces on the tension element 2.

In the embodiment illustrated, an operating element 13 in the form of a release tab, on which a user can pull in order to open the toggle lever closure 1, is arranged on the attachment element 117. By lifting of the tensioning element 12 by way of a handle 122 and by pulling on the operating element 13, the toggle lever closure 1 can be opened and the attachment element 117 released from the first closure element 10.

It is also conceivable and possible here, in a modified refinement, not to provide any handle 122 on the tensioning element 12, but rather to allow the operating element 13 to project below the tensioning element 12 in the closed position. Then, by pulling on the operating element 13, in one movement sequence the tensioning element 12 can be lifted and the attachment element 117 released from the first closure element 10.

In the embodiments described above, the engagement portion 112 is extended rectilinearly along the first pivot axis D1. However, this is not limiting. Other configurations of the engagement portion 112 are also conceivable.

Figure 8:
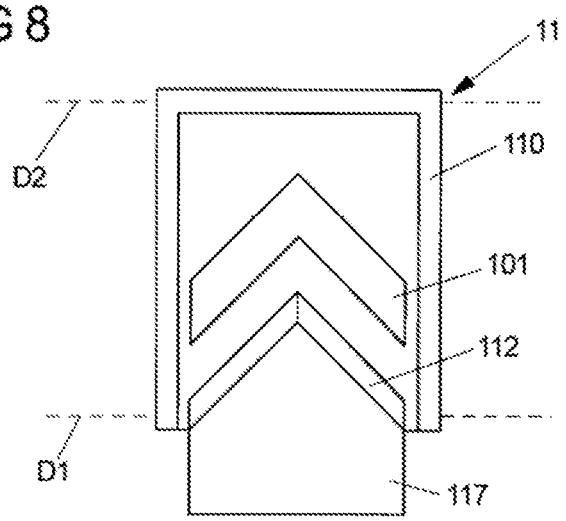
FIG. 8 shows a schematic view of another embodiment of a toggle lever closure.

For example, the engagement portion 112 can form a V shape, as is illustrated schematically in FIG. 8. In this case, the engagement portion 112 can enter into engagement with a fastening element 101 likewise of V-shaped design on the first closure element 10 and can thus produce a positively locking connection with a second closure element 11 which is fitted onto the first closure element 10.

In this case, the attachment element can be designed as is described, for example, in WO 2014/090926 A1.

In the embodiments described above, the second closure element 11 is to be (releasably) attached to the first closure element 10 in order to close the toggle lever closure 1. During the opening of the toggle lever closure 1, the second closure element 11 can be removed from the first closure element 10 in order thereby to release the connection between the second closure element 11 and the first closure element 10.

Figure 9:
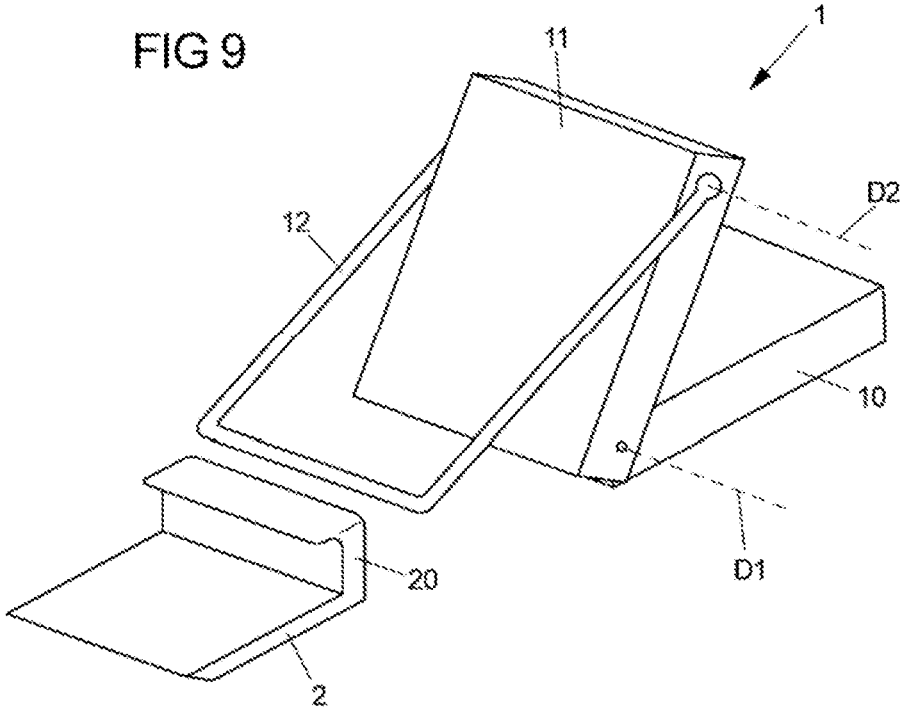
FIG. 9 shows a schematic view of a further embodiment of a toggle lever closure.

In another refinement, illustrated schematically in FIG. 9, it is also conceivable, however, to connect the second closure element to the first closure element 10 in an articulated, but nonreleasable, manner about the first pivot axis D1. The tensioning element 12 can act here on the second closure element 11, for example in an articulated and likewise nonreleasable manner pivotably about the second pivot axis D2, wherein the tensioning element 12 can be connectable releasably to the tension element 2, for example by the tensioning element 12 being hooked into a hook 20 of the tension element 2. A toggle lever closure 1 is again provided, in which, by pivoting of the second closure element 11, tensioning forces can be exerted on the tension element 2.

It is also conceivable, in a modified refinement, in the embodiment according to FIG. 9, to configure the connection of the tensioning element 12 to the tension element 2 to be nonreleasable. In this case, by closing of the toggle lever closure 1, tensioning can be brought about which can be relaxed by opening of the toggle lever closure 1 without, however, parts in this case being released from one another.

The concept on which the solution is based is not restricted to the embodiments described above, but rather can basically also be realized in an entirely different manner.

A toggle lever closure of the type described here is usable in an entirely different manner for the tensioning connection of parts to one another. One application can reside in the fastening of an orthopedic aid, for example an orthosis, to a patient, wherein, in this case, the orthopedic aid is arranged on an extremity of the patient in a tensioned manner by means of one or more toggle lever closures. However, a toggle lever closure of the type described here can also be used, for example, for closing a container, for example a crate or a bag, or for closing a sports shoe, for example a ski boot.

LIST OF REFERENCE SIGNS

1 Toggle lever closure
10 Closure element
100 Body
101 Fastening element
102 Projection
103, 103' Magnetic element
104 Sliding surface
105 Latching device
106 Latching recess
107 Blocking element (projection)
11 Closure element
110 Pivoting part
111 Opening
112 Engagement portion
113, 113' Magnetic element
114 Sliding surface
115, 116 Transverse strut
117 Attachment element

118, 119 Arm
118A, 119A End
12 Tensioning element
120 Connecting element (clip)
121 Ends
122 Handle
123 Connecting portion
124 Latching device
13 Engagement element (release tab)
2 (Flexible) tension element (tape)
20 Hook
3 Object (splint element)
A Distance
B Limb (leg)
D1, D2 Pivot axis
S1, S2 Pivoting direction

The invention claimed is:

1. A toggle lever closure, comprising a first closure element, a second closure element which is pivotable about a first pivot axis at a first end of the second closure element with respect to the first closure element in order to close the toggle lever closure, a tensioning element which is connected in an articulated manner to the second closure element about a second pivot axis at a second end of the second closure element opposite the first end;

at least one magnetic device which acts at least one of between the first closure element and the second closure element and between the first closure element and the tensioning element, and a tension element connected to the tensioning element at an end of the tensioning element opposite the second pivot axis, wherein, for closing the toggle lever closure, the second closure element is configured to be pivoted about the first pivot axis with respect to the first closure element, causing the second end of the second closure element with the tensioning element arranged thereon to be moved about the first pivot axis such that said end of the tensioning element opposite the second pivot axis is approached towards the first end of the second closure element for tensioning the tension element, wherein the second closure element is attachable to the first closure element in order to close the toggle lever closure and is removable from the first closure element in order to open the toggle lever closure, wherein the first closure element has a fastening element and the second closure element has an engagement portion, wherein the engagement portion is attachable to the fastening element for establishing an articulated connection of the second closure element to the first closure element, and wherein the second closure element has a pivoting part and an attachment element which is connected in an articulated manner to the pivoting part, is attachable to the first closure element and on which the engagement portion is formed.

2. The toggle lever closure as claimed in claim 1, wherein the engagement portion is formed by a strut element extending longitudinally along the first pivot axis.

3. The toggle lever closure as claimed in claim 1, wherein the engagement portion is extended along the first pivot axis, at an oblique angle with respect to the first pivot axis or in a V-shaped manner.

4. The toggle lever closure as claimed in claim 1, wherein the magnetic device is designed in order, upon attachment, to draw the engagement portion magnetically into engagement with the fastening element.

5. The toggle lever closure as claimed in claim 1, wherein the tensioning element has a connecting element which is fixedly connected or releasably connectable to the tension element for transmitting tensile forces.

6. The toggle lever closure as claimed in claim 5, wherein, in a closed position, the second closure element is arranged with respect to the first closure element in such a manner that the connecting element of the tensioning element and the second pivot axis come to lie on different sides of the first pivot axis.

7. The toggle lever closure as claimed in claim 6, wherein the first closure element has a first body and the second closure element has a second body, wherein, in the closed position of the toggle lever closure, the first body and the second body are in contact with each other at least in sections.

8. The toggle lever closure as claimed in claim 6, wherein, at a location which is spaced apart from the first pivot axis, the magnetic device acts in a magnetically attracting manner between the first closure element and the second closure element or between the first closure element and the tensioning element in order to hold the toggle lever closure in the closed position.

9. The toggle lever closure as claimed in claim 6, further comprising a latching device which is designed to mechanically latch the first closure element and the second closure element to each other in the closed position.

10. The toggle lever closure as claimed in claim 1, wherein the tensioning element is prestressed in relation to the second closure element about the second pivot axis in towards a preferred position.

11. The toggle lever closure as claimed in claim 1, wherein the second closure element has arms which are offset with respect to each other along the second pivot axis and act on the tensioning element at different locations offset with respect to each other transversely with respect to the second pivot axis.

12. The toggle lever closure as claimed in claim 1, further comprising an operating element, which is arranged on the second closure element, for opening the toggle lever closure.

13. A toggle lever closure, comprising a first closure element, a second closure element which is pivotable about a first pivot axis at a first end of the second closure element with respect to the first closure element in order to close the toggle lever closure, a tensioning element which is connected in an articulated manner to the second closure element about a second pivot axis at a second end of the second closure element opposite the first end;

at least one magnetic device which acts at least one of between the first closure element and the second closure element and between the first closure element and the tensioning element, and a tension element connected to the tensioning element at an end of the tensioning element opposite the second pivot axis, wherein, for closing the toggle lever closure, the second closure element is configured to be pivoted about the first pivot axis with respect to the first closure element, causing the second end of the second closure element with the tensioning element arranged thereon to be moved about the first pivot axis such that said end of the tensioning element opposite the second pivot axis is approached towards the first end of the second closure element for tensioning the tension element, wherein the second closure element is attachable to the first closure element in order to close the toggle lever closure and is removable from the first closure element in order to open the toggle lever closure, wherein the first closure element has a fastening element and the second closure element has an engagement portion, wherein the engagement portion is attachable to the fastening element for establishing an articulated connection of the second closure element to the first closure element, and wherein a first magnetic element is arranged in a region of the fastening element and a second magnetic element is arranged in a region of the engagement portion, wherein the first magnetic element and the second magnetic element are designed in order, upon attachment, to draw the engagement portion magnetically into engagement with the fastening element.

14. A closure device, comprising a first closure element which comprises a fastening element in forming a hook, and a second closure element which comprises a wire clip configured to be attached to the fastening element of the first closure element and a second closure part, wherein the first closure element interacts with the second closure element in a magnetically attracting manner, wherein the wire clip is attached to the second closure part at a first end of the wire clip at a pivot axis on the second closure part, and wherein the wire clip is configured to engage with the hook of the fastening element at a second end of the wire clip provided opposite the first end of the wire clip.

15. The closure device as claimed in claim 14, wherein the first closure element has a first magnetic element or is manufactured at least in sections from a ferromagnetic material, and/or the second closure element has a second magnetic element or is manufactured at least in sections from a ferromagnetic material.

* * * * *